US008083496B2

(12) United States Patent
Stilwell

(10) Patent No.: US 8,083,496 B2
(45) Date of Patent: Dec. 27, 2011

(54) AIR COMPRESSOR ENCLOSED IN SHROUD HAVING TAB ISOLATOR

(75) Inventor: J. Cody Stilwell, Jackson, TN (US)

(73) Assignee: Black & Decker Inc., Newark, DE (US)

( * ) Notice: Subject to any disclaimer, the term of this patent is extended or adjusted under 35 U.S.C. 154(b) by 326 days.

(21) Appl. No.: 12/046,910

(22) Filed: Mar. 12, 2008

(65) Prior Publication Data

US 2008/0152518 A1 Jun. 26, 2008

Related U.S. Application Data

(63) Continuation of application No. 10/805,836, filed on Mar. 22, 2004, now abandoned.

(60) Provisional application No. 60/459,804, filed on Apr. 2, 2003.

(51) Int. Cl.

| | |
|---|---|
| ***F04B 53/00*** | (2006.01) |
| ***B65D 81/02*** | (2006.01) |
| ***B65D 85/30*** | (2006.01) |
| ***B65D 25/24*** | (2006.01) |
| ***A47G 29/00*** | (2006.01) |

(52) U.S. Cl. ..... 417/234; 206/592; 211/85.18; 220/631

(58) Field of Classification Search ..... 417/234, 417/423.14, 572; 206/315.9, 446, 592, 594, 206/765, 814; 220/565, 647, 646, 635, 631, 220/630, 628; 211/71.1, 74, 85.18, 85.22, 211/71.01

See application file for complete search history.

(56) References Cited

U.S. PATENT DOCUMENTS

| | | | | |
|---|---|---|---|---|
| 2,329,765 | A * | 9/1943 | Jackson et al. | 220/560.09 |
| 3,387,811 | A * | 6/1968 | Adams, Jr. | 248/146 |
| 4,150,806 | A * | 4/1979 | Dziuk | 248/154 |
| D336,408 | S * | 6/1993 | Tersch et al. | D7/619.1 |
| 5,292,001 | A * | 3/1994 | Langenbeck et al. | 206/518 |
| 5,927,915 | A * | 7/1999 | Grove, Sr. | 410/49 |
| 2004/0047744 | A1* | 3/2004 | Burkholder et al. | 417/234 |

* cited by examiner

*Primary Examiner* — Devon C Kramer
*Assistant Examiner* — Peter J Bertheaud
(74) *Attorney, Agent, or Firm* — Rhonda L. Barton; Michael P. Leary; Adan Ayala

(57) ABSTRACT

The present invention is directed to an air compressor enclosed in a shroud with plastic tab isolators. In an exemplary aspect of the present invention, an air compressor may include an air tank for containing air at an elevated pressure, and a shroud for enclosing the air tank. The shroud may include a ribbing and a plurality of support members. The ribbing and the plurality of support members may be in contact with the air tank to assist in holding the air tank inside the shroud.

17 Claims, 6 Drawing Sheets

AIR COMPRESSOR ENCLOSED IN SHROUD HAVING TAB ISOLATOR

CROSS-REFERENCE TO RELATED DOCUMENTS

The present application is a continuation of U.S. patent application Ser. No. 10/805,836 filed Mar. 22, 2004, now abandoned entitled "Air Compressor Enclosed in Shroud having Tab Isolator" now abandoned, which claims the benefit under 35 U.S.C. §. 119(*e*) of U.S. Provisional Patent Application Ser. No. 60/459,804, entitled "Air Compressor Enclosed in Shroud with Plastic Tab Isolator," filed Apr. 2, 2003. Both applications are herein incorporated by reference in their entirety.

FIELD OF THE INVENTION

The present invention relates generally to air compressors and particularly to an air compressor enclosed in a shroud having tab isolators.

BACKGROUND OF THE INVENTION

Air compressors are widely used in household and industrial applications for operating air powered tools such as fasteners, socket driving tools, material shapers, sanders, sprayers, inflation chucks, and the like. An air compressor typically includes an air tank for storing compressed air, a compressor for supplying compressed air to the air tank, and a manifold assembly for controlling and distributing compressed air from the portable air compressor to one or more air powered tools. Conventionally, a portable air compressor may include a shroud or housing, which encloses the air tank, the compressor, and the manifold assembly. The shroud, which is preferably formed of plastic, may include a handle for allowing an operator to lift and transport the portable air compressor between worksites.

An air tank enclosed in a shroud of an air compressor conventionally has a known tolerance due to the manufacturability of the tank head and the welding process of the tank. This tolerance often leads to the difficulty in designing a general-purpose shroud ribbing that may firmly hold air tanks of a range of sizes in place. In other words, if the ribbing is designed to firmly hold a nominal tank (e.g., an air tank with a medium tolerance) in place, there would be an extra space between the tank and the shroud for a minimum tolerance tank (thus the minimum tolerance tank may move in the shroud); on the other hand, a maximum tolerance tank would not fit inside the ribbing at all. This often leads to manufacture inefficiency.

Thus, it would be desirable to provide an apparatus and method for securing air tanks of a range of sizes within a known tolerance inside a shroud of an air compressor.

SUMMARY OF THE INVENTION

Accordingly, the present invention is directed to an air compressor enclosed in a shroud with plastic tab isolators. In an exemplary aspect of the present invention, an air compressor includes an air tank for containing air at an elevated pressure, and a shroud for enclosing the air tank. The shroud may include a ribbing and a plurality of support members. The ribbing and the plurality of support members may be in contact with the air tank to assist in holding the air tank inside the shroud.

In an additional exemplary aspect of the present invention, a portable air compressor includes an air tank for containing air at an elevated pressure, and a shroud for enclosing the air tank. The shroud may include a ribbing and a plurality of support members. The ribbing may include a first group of ribs and a second group of ribs. The first group of ribs may be perpendicular to the second group of ribs. The ribbing and the plurality of support members may be in contact with the air tank to assist in holding the air tank inside the shroud.

In another exemplary aspect of the present invention, a shroud for enclosing an air tank of an air compressor includes a ribbing extending from an inner wall of the shroud, and a plurality of support members extending from the inner wall of the shroud. The ribbing may include a first group of ribs and a second group of ribs. The ribbing and the plurality of support members may be in contact with the air tank to assist in holding the air tank inside the shroud.

In a further exemplary aspect of the present invention, a method for holding air tanks of a range of sizes inside a shroud of an air compressor may include the following steps: (a) placing a ribbing on an inner wall of the shroud so that the ribbing may hold an air tank of a maximum size; and (b) placing a plurality of support members on the inner wall so that the plurality of support members may hold an air tank of a minimum size.

It is to be understood that both the foregoing general description and the following detailed description are exemplary and explanatory only and are not restrictive of the invention as claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Reference will now be made in detail to the presently preferred embodiments of the invention, examples of which are illustrated in the accompanying drawings.

An air tank enclosed in a shroud of an air compressor conventionally has a known tolerance due to the manufacturability of the tank head and the welding process of the tank. This tolerance often leads to the difficulty in designing a general-purpose shroud ribbing that may firmly hold air tanks of a range of sizes in place. In other words, if the ribbing is designed to firmly hold a nominal tank (e.g., an air tank with a medium tolerance) in place, there would be an extra space between the tank and the shroud for a minimum tolerance tank (thus the minimum tolerance tank may move in the shroud); on the other hand, a maximum tolerance tank would not fit inside the ribbing at all. This often leads to manufacture inefficiency. One purpose of the present invention is to address this problem.

Figure 1:
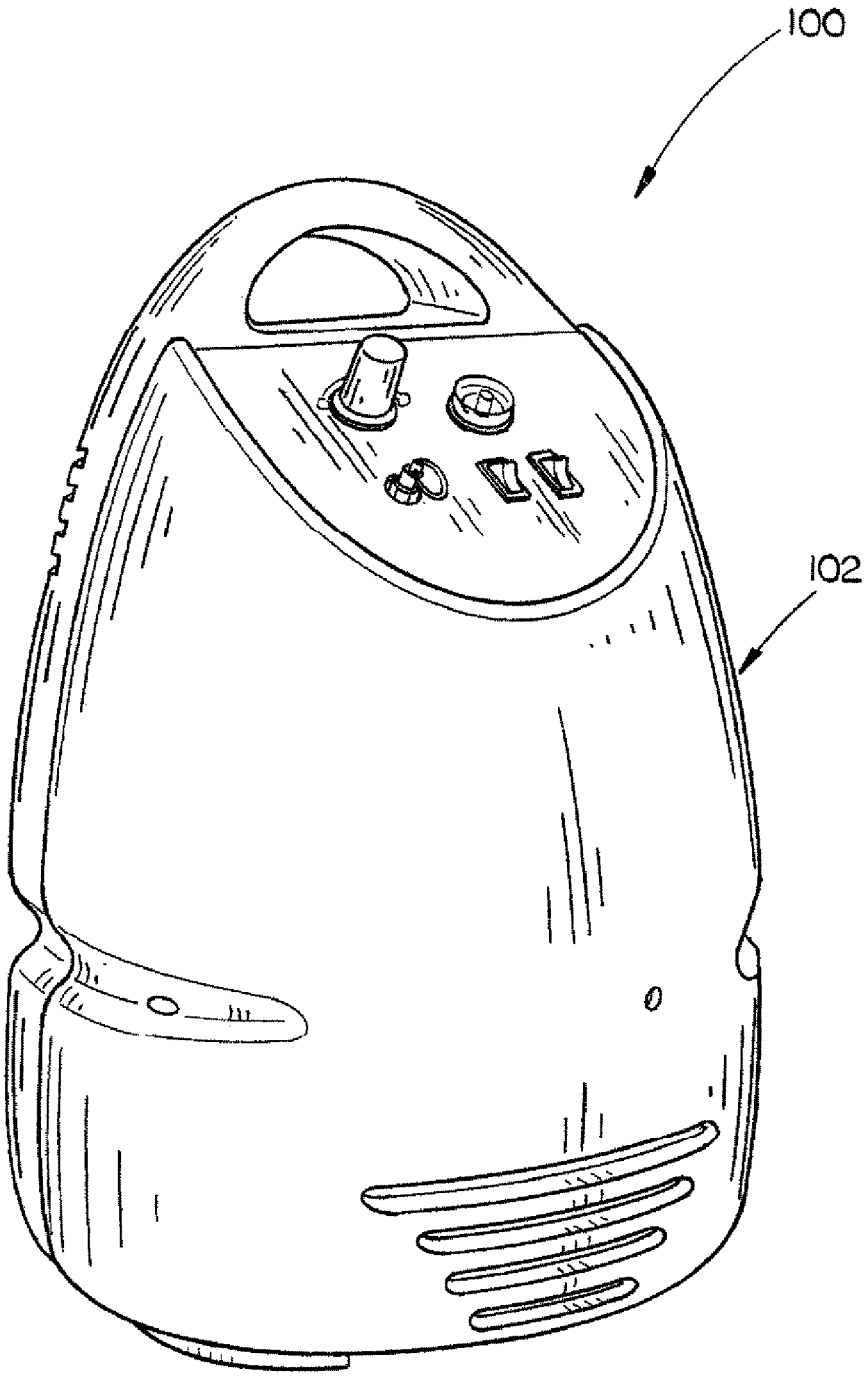
FIG. 1 is an isometric view illustrating an air compressor in accordance with an exemplar embodiment of the present invention.
Figure 2:
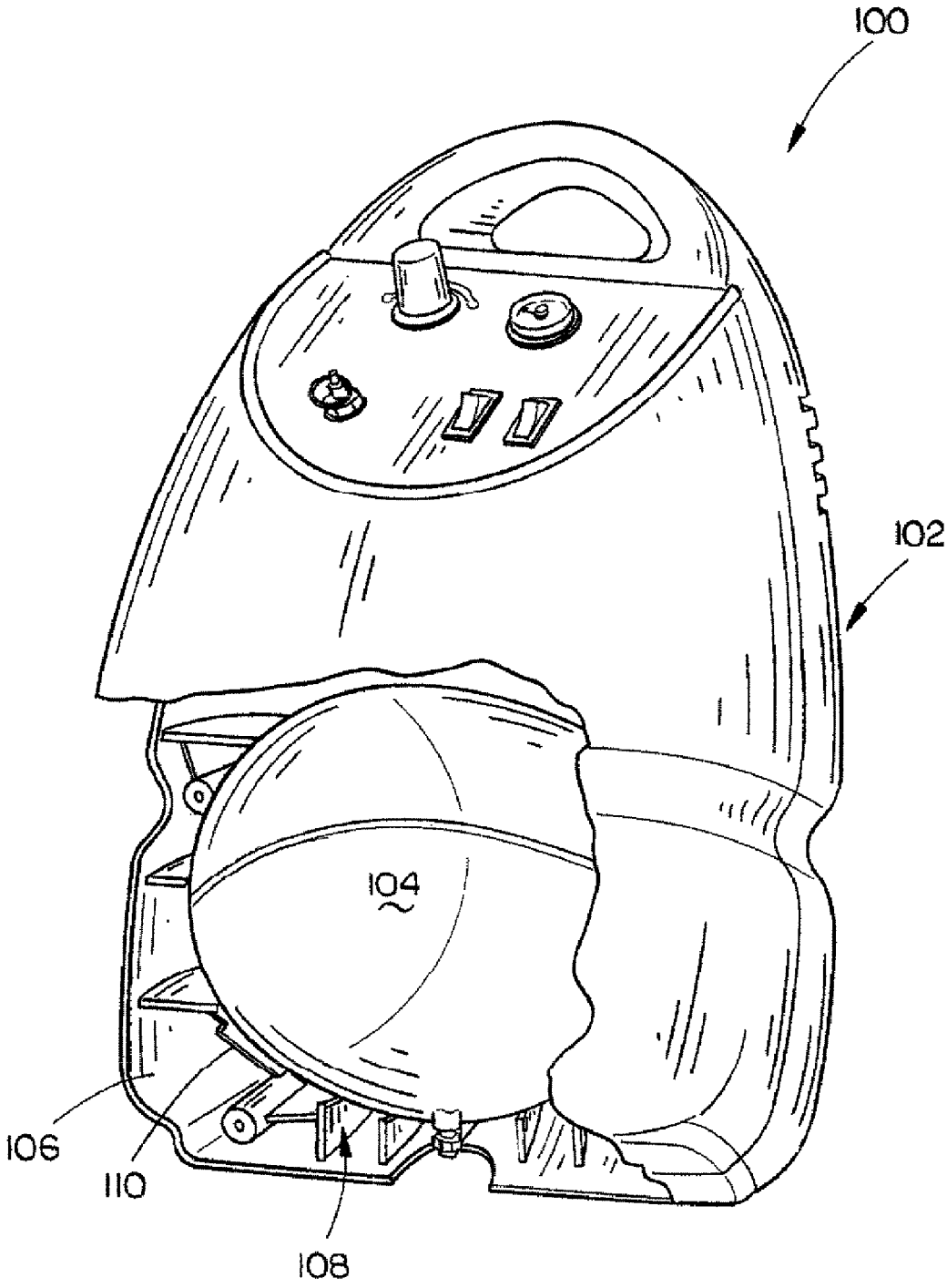
FIG. 2 is a cut-away view of the portable air compressor assembly shown in FIG. 1, showing an air tank, a shroud ribbing and a support member.
Figure 3:
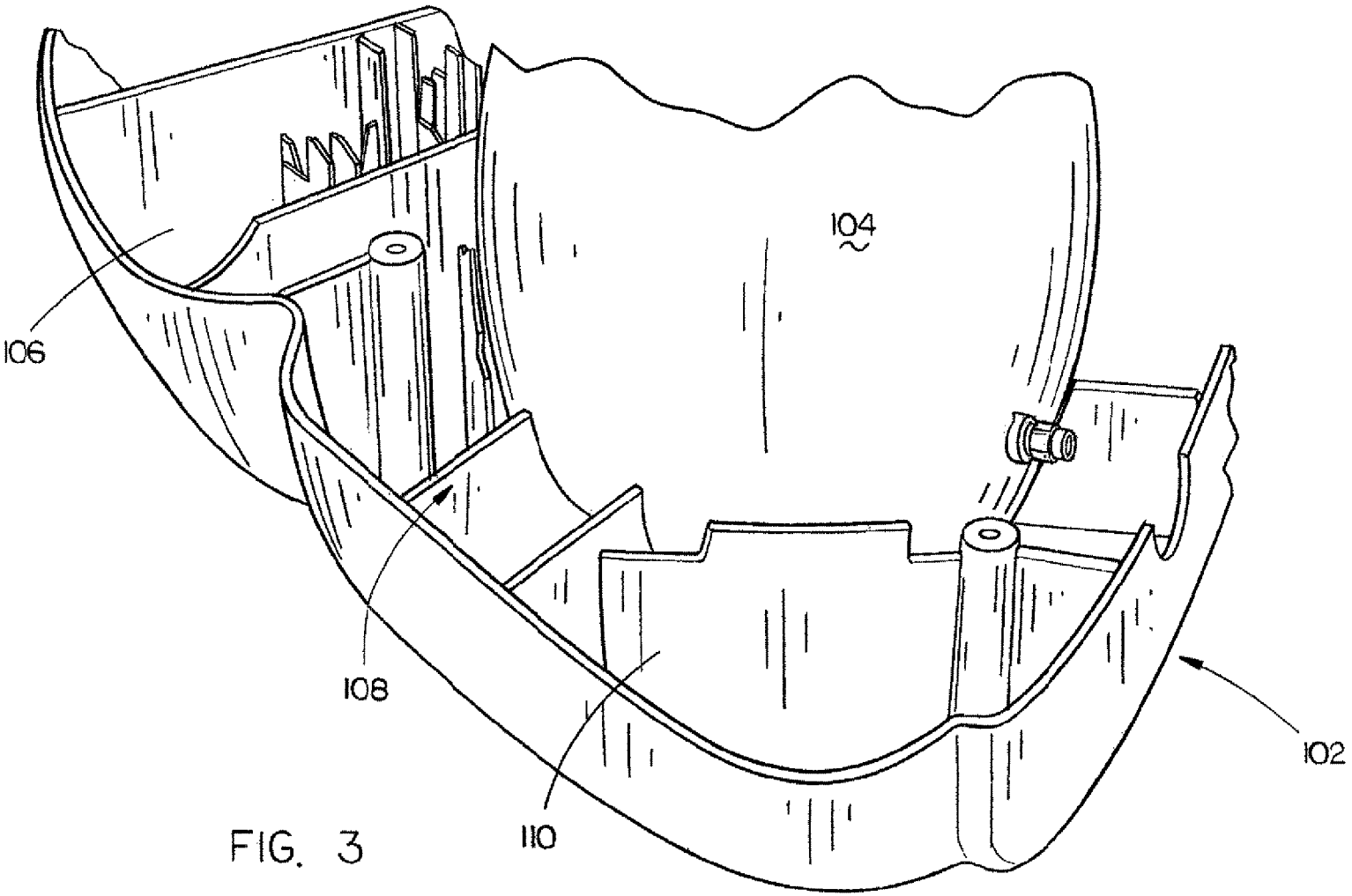
FIG. 3 further illustrates the air tank, the shroud ribbing, and the support member shown in FIG. 2.
Figure 4:
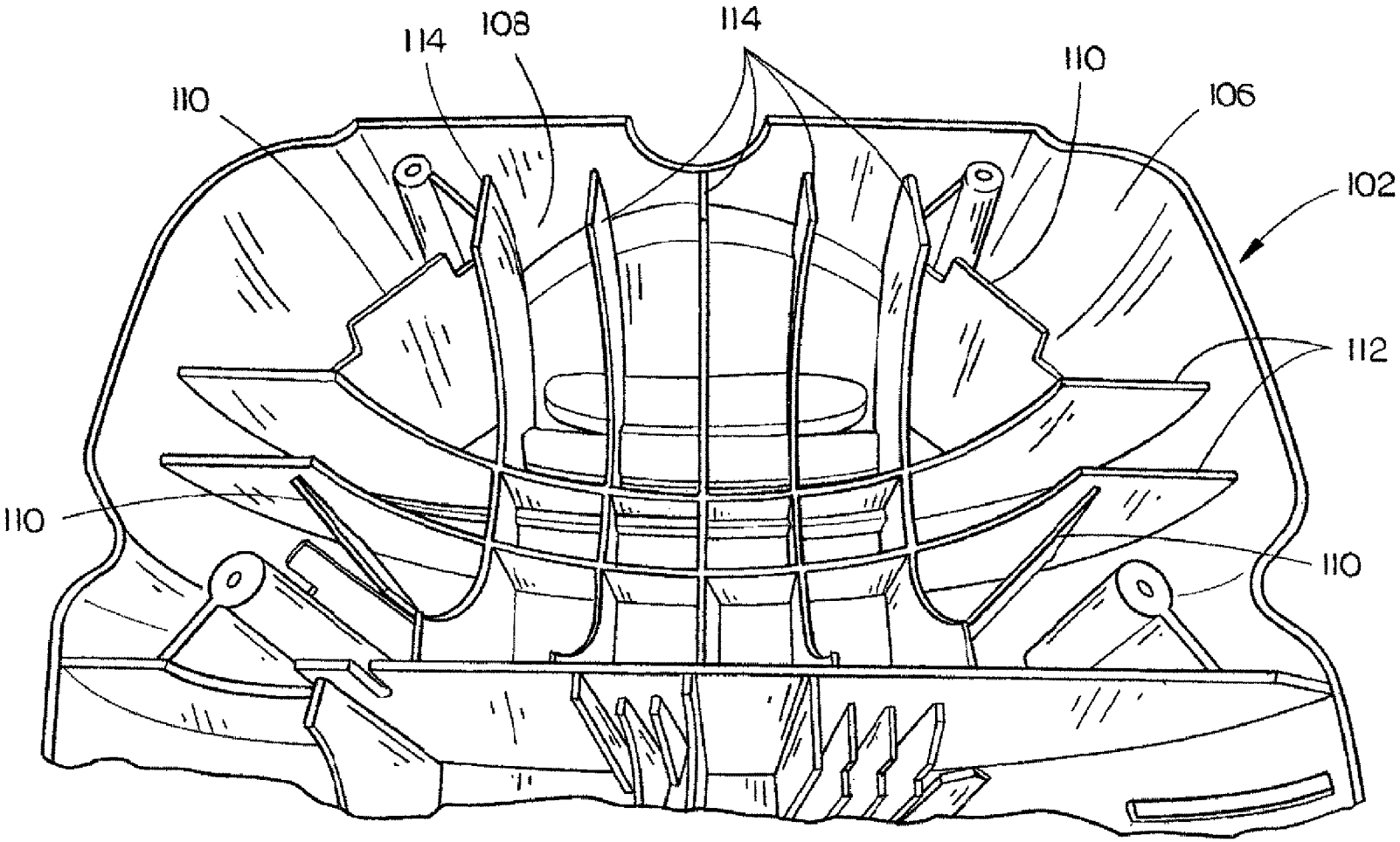
FIG. 4 illustrates the shroud ribbing and the support member shown in FIG. 2 in accordance with an exemplary embodiment of the present invention.
Figure 5:
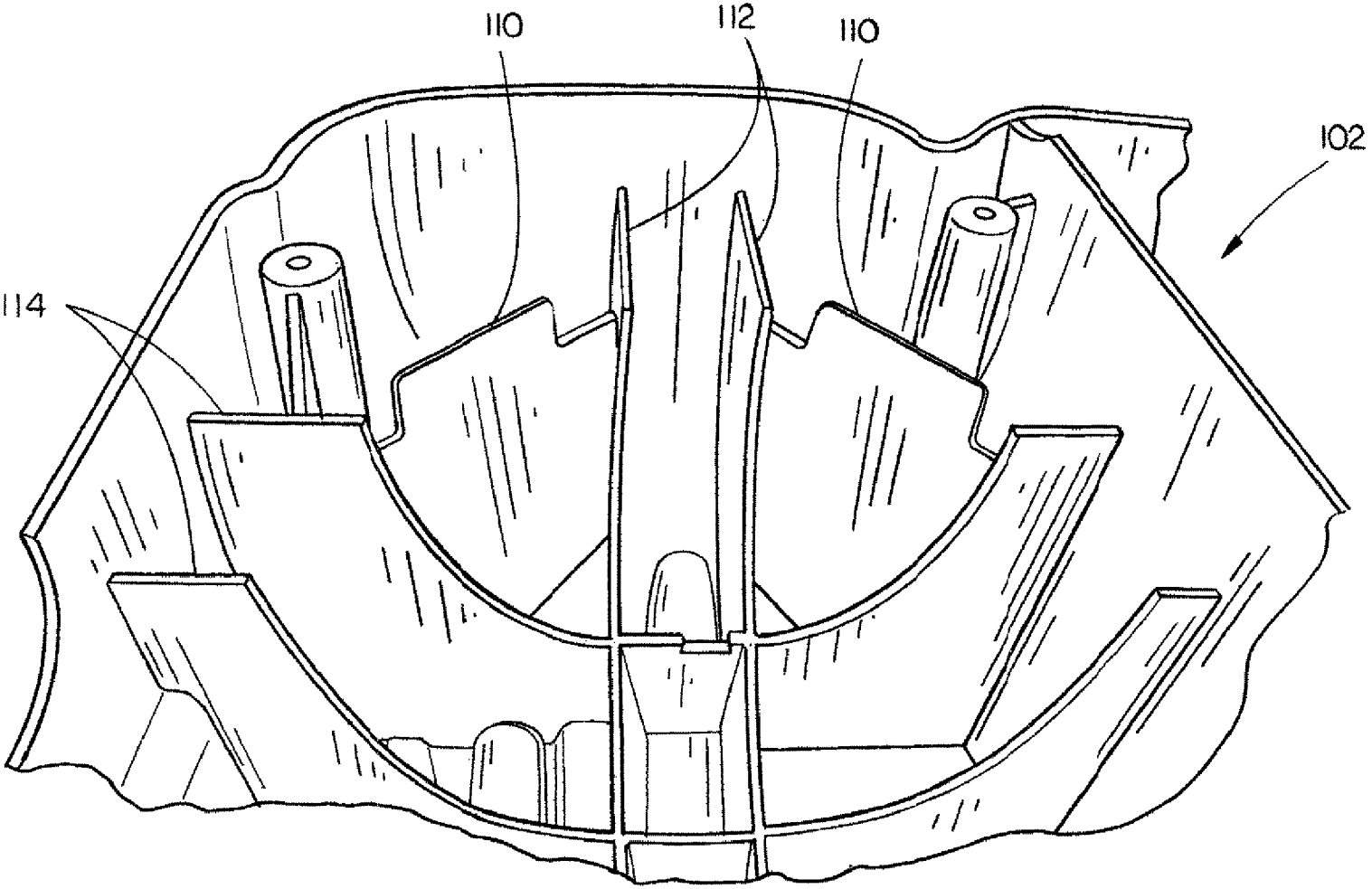
FIG. 5 is a partial view of the shroud ribbing and the plurality of support members shown in FIG. 4.
Figure 6:
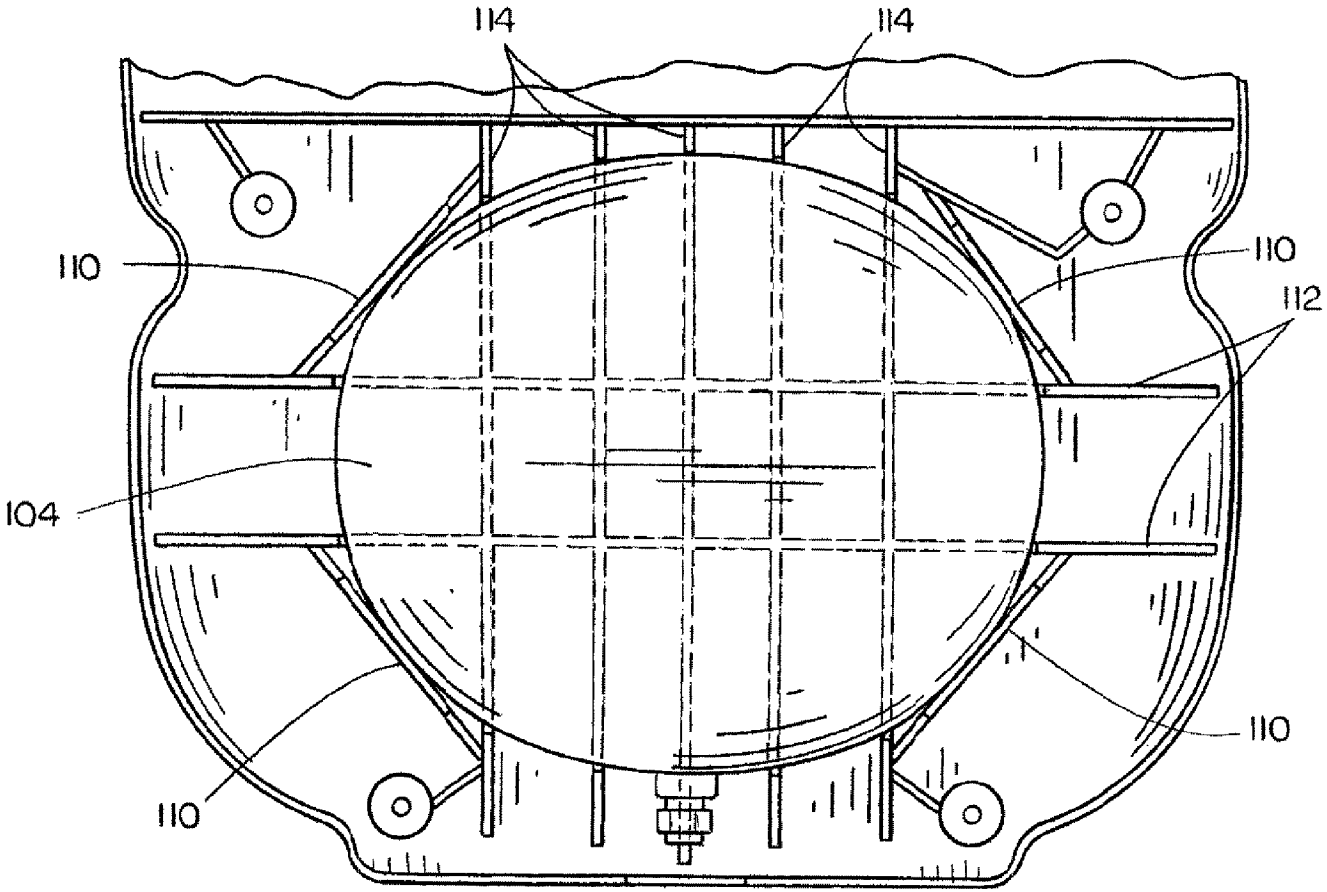
FIG. 6 is a partial right elevation view of the air compressor shown in FIG. 2.

Referring generally now to FIGS. 1 through 7, an exemplary portable air compressor 100 in accordance with the present invention is shown. The portable air compressor 100 may include an air tank 104 for storing compressed air, a compressor for supplying compressed air to the air tank 104, and a manifold assembly for controlling and distributing compressed air from the portable air compressor 100 to one or more air powered tools. The portable air compressor 100 may include a shroud or housing 102, which encloses the air tank 104, the compressor, and the manifold assembly. The shroud 104, which is preferably formed of plastic, may include a handle for allowing an operator to lift and transport the portable air compressor 100 between worksites. The shroud may include a ribbing 108 extending from an inner wall 106 of the shroud 102. The ribbing 108 may include a first group of ribs 112 in a first direction and a second group of ribs 114. Preferably, the first group of ribs 112 intersects and is perpendicular to the second group of ribs 114 (see e.g., FIGS. 4-6). The first group of ribs 112 and the second group of ribs 114 may be configured based on the shape of the air tank 104. For example, the first group of ribs 112 and the second group of ribs 114 may be at least partially contoured to generally conform to a rounded tank. In a preferred embodiment, the ribbing 108 may be so designed that the ribbing 108 may hold a maximum tolerance tank (i.e., an air tank of a maximum size within a known tolerance). Thus, any air tank within the known tolerance may fit inside the ribbing 108. However, this may generate an extra space between the shroud 102 and the tank 104 for a tank that is not at the high end of the tolerance.

According to an aspect of the present invention, the shroud 102 may include a plurality of support members 110 extending from the inner wall 106 of the shroud 102. Preferably, the plurality of support members 110 are made of plastic. Thus, the flexibility inherent in the plastic may be utilized to design the shroud 102 that firmly holds an air tank 104 within a known tolerance. The plurality of support members 110 may be shaped like tabs, or the like. Each of the plurality of support members 110 may be positioned between a rib belonging to the first group of ribs 112 and a rib belong to the second group of ribs 114. Preferably, the plurality of support members 110 may be symmetrically positioned so as to secure the tank 104 uniformly. The plurality of support members 100 may be so designed that the plurality of support members 100 may firmly hold a minimum tolerance tank (i.e., an air tank of a minimum size within a known tolerance).

By creating the ribbing 108 that may hold a maximum tolerance tank within a known tolerance and the plurality of support members 110 that may hold a minimum tolerance tank within the known tolerance, the shroud 102 of the present invention thus may firmly hold any tank within the known tolerance. This may increase manufacture efficiency. Because the plurality of support members 110 surrounds and interferes with the tank 104, the tank 104 may be maintained in place by the flex of the plastic, and any gap between the tank 104 and the shroud 102 may be taken up by the flex of the plurality of support members 110. Moreover, if the air compressor 100 is dropped to the ground or placed on its side, the plurality of support members 110 may spring accordingly to take up the gap on the needed side. Additionally, if the air compressor movement is too violent, then the ribbing 108 may prevent the tank 102 from moving too far.

It is understood that the specific order or hierarchy of steps in the processes disclosed is an example of exemplary approaches. Based upon design preferences, it is understood that the specific order or hierarchy of steps in the processes may be rearranged while remaining within the scope of the present invention. The accompanying method claims present elements of the various steps in a sample order, and are not meant to be limited to the specific order or hierarchy presented.

It is believed that the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages, the form herein before described being merely an explanatory embodiment thereof.

What is claimed is:

1. An air compressor, comprising:

an air tank for containing air at an elevated pressure;

a shroud for enclosing said air tank, said shroud including a ribbing and a plurality of support members, wherein said ribbing and said plurality of support members assist in holding said air tank inside said shroud, wherein said ribbing comprises a first group of ribs in a first direction and an intersecting second group of ribs in a second direction, wherein said first group of ribs and said second group of ribs combine to form a top surface, wherein each rib extends from an inner wall of said shroud to form said top surface, said top surface having flat end portions that extend from said inner wall of said shroud and a concave center portion between said flat end portions, said concave center portion contacting said air tank, and wherein each of said plurality of support members is disposed between and in contact with one of said first group of ribs and one of said second group of ribs.

2. The air compressor of claim 1, wherein said plurality of support members are made of plastic.

3. The air compressor of claim 1, wherein said ribbing is made of plastic.

4. The air compressor of claim 1, wherein said first direction is perpendicular to said second direction.

5. The air compressor of claim 1, wherein the height of each rib from said bottom surface to any point along the top surface is greater than the width of each rib.

6. A portable air compressor, comprising:

an air tank for containing air at an elevated pressure;

a shroud for enclosing said air tank, said shroud including a ribbing and a plurality of support members, said ribbing comprising a first group of ribs and a second group of ribs, said first group of ribs being perpendicular to and intersecting said second group of ribs, wherein said ribbing and said plurality of support members assist in holding said air tank inside said shroud, wherein said first group of ribs and said second group of ribs combine to form a top surface, wherein each rib extends from an inner wall of said shroud to form said top surface, said top surface having flat end portions that extend from said inner wall of said shroud and a concave center portion between said flat end portions, said concave center portion contacting said air tank, and wherein each of said plurality of support members is disposed between and in contact with one of said first group of ribs and one of said second group of ribs.

7. The portable air compressor of claim 6, wherein said plurality of support members are made of plastic.

8. The portable air compressor of claim 6, wherein said ribbing is made of plastic.

9. The portable air compressor of claim 6, wherein said plurality of support members are symmetrically positioned.

10. A shroud for enclosing an air tank of an air compressor, comprising:

a ribbing extending from an inner wall of said shroud, said ribbing including a first group of ribs and an intersecting second group of ribs;

and a plurality of support members extending from said inner wall of said shroud, wherein said ribbing and said plurality of support members assist in holding said air tank inside said shroud, wherein said first group of ribs and said second group of ribs combine to form a top surface, wherein each rib extends from an inner wall of said shroud to form said top surface, said top surface having flat end portions that extend from said inner wall of said shroud and a concave center portion between said flat end portions, said concave center portion contacting said air tank, and wherein each of said plurality of support members is disposed between and in contact with one of said first group of ribs and one of said second group of ribs.

11. The shroud of claim 10, wherein said plurality of support members are made of plastic.

12. The shroud of claim 10, wherein said ribbing is made of plastic.

13. The shroud of claim 10, wherein each of said plurality of support members is in contact with one of said first group of ribs and one of said second group of ribs.

14. The shroud of claim 10, wherein said first group of ribs is perpendicular to said second group of ribs.

15. The shroud of claim 14, wherein said plurality of support members are symmetrically positioned.

16. A method for holding air tanks of a range of sizes inside a shroud of an air compressor, comprising:

placing a ribbing on an inner wall of said shroud so that said ribbing may hold an air tank of a maximum size among said air tanks of a range of sizes said ribbing comprising a first group of ribs and a second group of ribs, said first group of ribs and said second group of ribs having combining to form a top surface, wherein each rib extends from an inner wall of said shroud to form said to surface, said top surface having flat end portions that extend from said inner wall of said shroud and a concave center portion between said flat end portions, said concave center portion contacting said air tanks, said first group of ribs being perpendicular to said second group of ribs; and placing a plurality of support members on said inner wall between and in contact with one of said first group of ribs and one of said second group of ribs, so that said plurality of support members may hold an air tank of a minimum size among said air tanks of a range of sizes.

17. The method of claim 16, wherein said plurality of support members are symmetrically positioned.

* * * * *